US005186161A

United States Patent [19]

Shumock

[11] Patent Number: 5,186,161

[45] Date of Patent: Feb. 16, 1993

[54] MODULAR FIREPLACE

[75] Inventor: Mark J. Shumock, Warrington, Pa.

[73] Assignee: Pyro Place, Inc., Warrington, Pa.

[21] Appl. No.: 745,394

[22] Filed: Aug. 15, 1991

[51] Int. Cl.[5] ..... F24B 1/18
[52] U.S. Cl. ..... 126/500; 52/593
[58] Field of Search ..... 126/500; 52/20, 21, 52/593-595; 98/58

[56] References Cited

U.S. PATENT DOCUMENTS

| | | | |
|---|---|---|---|
| 4,478,208 | 10/1984 | Pita | 126/500 |
| 4,686,807 | 8/1987 | Newsome | 126/500 X |
| 4,805,591 | 2/1989 | Pitha | 126/500 |
| 4,984,562 | 1/1991 | Pedersen et al. | 126/500 |

FOREIGN PATENT DOCUMENTS

| | | | |
|---|---|---|---|
| 2381974 | 10/1978 | France | 126/500 |

*Primary Examiner*—Larry Jones
*Attorney, Agent, or Firm*—Gregory J. Gore

[57] ABSTRACT

A modular fireplace construction utilizes interlocking corner joints in the fire block area to provide a stable, free-standing base for the smoke chamber and chimney sections above. Individual sections are cast from an extremely heat resistant composition containing Luminate cement and Perlite aggregate. The completed fireplace does not require the addition of a flue liner. Dowel apertures may be formed in the individual sections which receive handling dowels to enable assemblers to easily lift and accurately place the sections during assembly.

7 Claims, 4 Drawing Sheets

MODULAR FIREPLACE

FIELD OF THE INVENTION

The present invention relates to modular fireplaces, and more particularly to a modular fireplace which employs precast sections having interlocking planar sections.

BACKGROUND OF THE INVENTION AND PRIOR ART

Modular fireplace construction of an open-type fireplace commonly found in residential structures is well-known. The advantages of modular fireplace construction and installation are primarily in the reduced cost of the precast fireplace sections, which can be molded into smaller and lighter pieces, than ordinary masonry block. There are also cost savings realized through reduced labor required for construction.

The following U.S. patents describe various types of modular open fireplace construction. These include U.S. Pat. No. 4,686,807 to Newsome; U.S. Pat. No. 4,984,562 to Pederson et al; U.S. Pat. No. 4,478,208 to Pitha; and U.S. Pat. No. 1,069,944 to Haggard. While the above-mentioned modular fireplaces have an advantage over free-built structures, the prior art fireplaces are difficult to assemble because the individual sections are not easy to handle and many of the pieces appear almost identical. Thus, assemblers are often confused about finding the proper location for the various pieces. Furthermore, the various sections of the modular fireplaces are made from ordinary masonry materials which require an additional flue liner to be inserted into the chimney area after completion. The above-mentioned problems with the prior art have been solved by the applicant's novel modular fireplace construction, assembly method, and material composition.

SUMMARY OF THE INVENTION

The applicant has devised a unique fireplace construction that saves labor and installation time by providing sections with different shapes and dimensions, which make it readily apparent to the assembler where the individual sections are located. Simplicity and ease of assembly is also achieved by the use of easy to handle sections. Because the modular precast sections are of lighter weight than masonry block and are interlocking, the present fireplace may be free-standing. Prior art fireplaces are required to be set in a cement base. The fireplace construction will now be described.

Built on a large planar base, three rectangular sections are located around three sides of the base creating two lateral sides and the back of the firebox. The completed firebox is comprised of three vertically extending tiers, each tier being successively shorter in height. The height difference among the tiers helps identify which pieces belong on a given tier. The tiers are joined by interlocking jaws which connect the individual sections of each tier at the corners. The outer sides of the firebox are not angled and offer a solid load-bearing base for support of the smoke chamber and chimney above. The firebox is completed with the addition of a face plate, which is located across the top front of the firebox. With the face plate in place, the top tier of the firebox becomes a completed rectangular collar with four sections interlocking at all four corners. It will be understood that by these mechanical relations, the interlocking sections of the firebox withstand the vertical forces from the weight of the smoke chamber and chimney portions above without separating.

The next portion of the fireplace is the smoke chamber which rests upon the firebox. The function of the smoke chamber is to interconnect the large mouth at the top of the firebox with the much smaller chimney opening. This is accomplished by way of two tapered lateral sides. Deviating from the prior art, however, all four sides of the upward extending smoke chamber are not angled inward to provide the required taper. In the present device, only the front and rear sections are vertically standing and are load-bearing, while angled side sections are non-load-bearing. Because the front and rear faces of the smoke chamber are vertical and support all of the weight of the chimney above, there is no need for complicated joinery at the corners of the smoke chamber. In the present device, the corners of the smoke chamber faces are in simple end-to-side abutment without any interlocking tongues or grooves. This makes insulation of the smoke chamber extremely simple and makes the smoke chamber sections readily identifiable, since the firebox sections are both of a different shape and have interlocking jaws at the corners. The front and rear face of the smoke chamber are comprised of four trapezoidal sections on each face. The left and right side sections are one piece and are rectangular.

In an alternate embodiment, the basic fireplace construction described above may be supplemented by the addition of a second tier to the smoke chamber, which includes two vertically-standing trapezoidal front and rear sections and two angled rectangular side sections. This second tier includes horizontal top and bottom faces which rest directly upon the opening of the top of the smoke chamber.

In yet another embodiment, the firebox construction is the same, however, the smoke chamber has three vertically-standing sides and only one sloping face. This construction is particularly useful for installations where the fireplace is located adjacent an existing vertical heater flue on one side.

In order to simplify the overall construction of the fireplace and chimney, the modular sections have been cast from a composition which can withstand the extreme heat-resistance required of the chimney, yet provide the structural strength and lack of brittleness required of the precast components. Cast from this type of material, the completed fireplace does not require the addition of a flue liner, thus providing further cost savings in both labor and materials. In order to speed assembly of the above-described fireplaces, sections include apertures for receiving handling dowels. The dowel apertures are formed at an upward angle to the outside face of the individual sections and receive dowels which enable the assemblers to easily lift and accurately place each modular section into position during assembly. The angle of the dowel holes also indicates the top and bottom surfaces of each section, since all the holes are inclined upward in the finished assembly.

It is, therefore, an object of the present invention to provide a modular fireplace construction with individual cast elements which are easy to identify and locate. It is a further object of the present invention to provide a modular fireplace with precast sections of a composition which eliminates the need for an additional flue liner. It is a further object of the present invention to provide a modular fireplace with precast modular sections with means which permit the ease of handling of heavy sections.

Other objects and advantages of the present invention will be readily apparent by the foregoing drawings and description of the preferred embodiment.

DESCRIPTION OF THE PREFERRED EMBODIMENT

Figure 1:
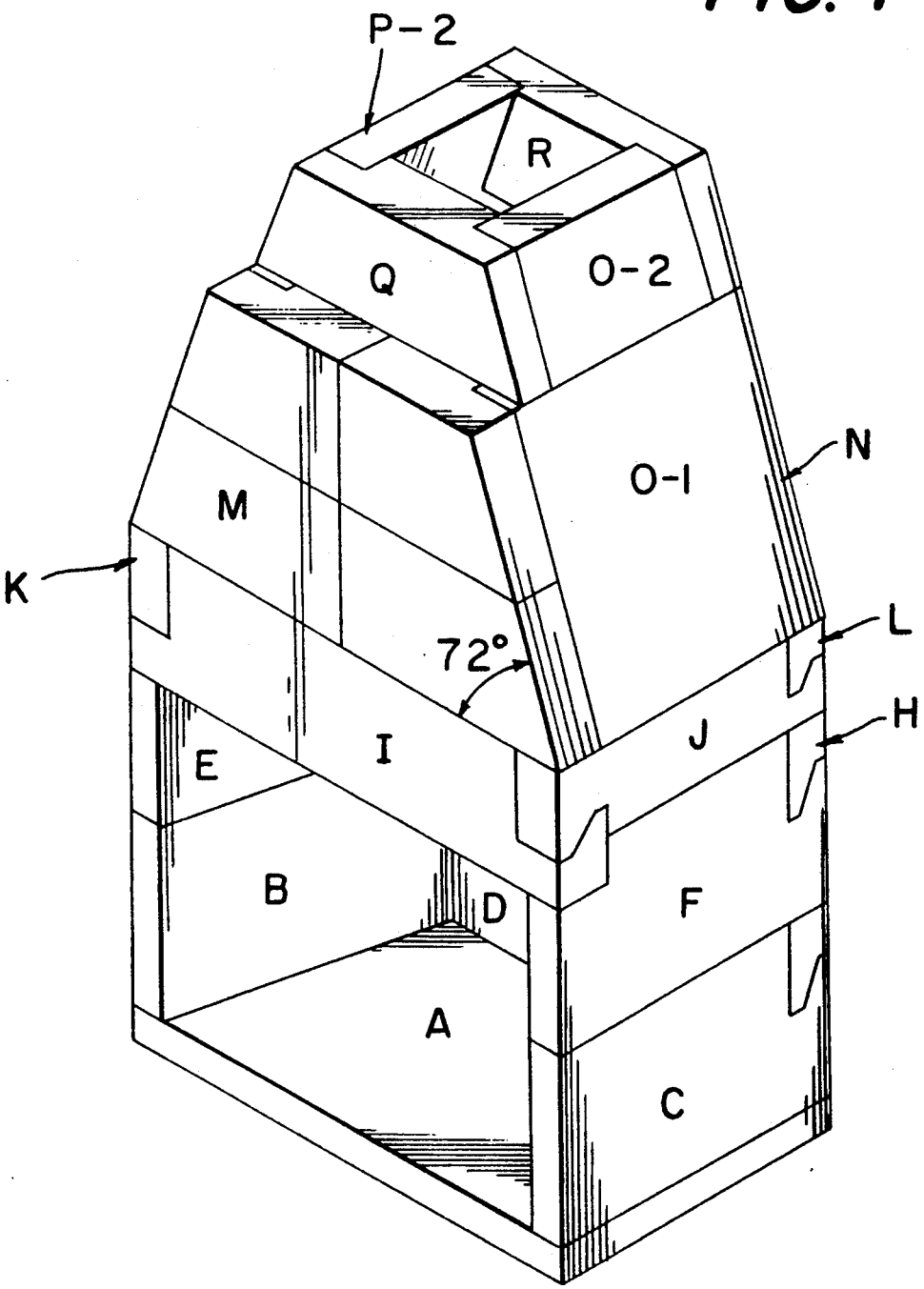
FIG. 1 is a top right front isometric view of the present invention in its assembled condition.

Referring now to FIG. 1, a complete assembled fireplace of the present invention is shown. A substantially rectangular firebox at the bottom supports a tapered smoke chamber which has angled sides and rests on top of the firebox. Beginning at the bottom, base A is a flat rectangular planar piece that supports the fireplace. Upon the base A rests three elements of the first firebox tier sections B, D and C. Upon these sections rests a second tier slightly shorter in height which includes side sections E and F. The third and final tier to the firebox is the shortest of the three firebox tiers and is comprised of sections K, I, J and L. The precise interlocking and shape of the firebox sections is shown in FIG. 2.

The tapered smoke chamber is constructed from a front face M having four trapezoidal sections with a notch on the sides to accommodate the abutting edge of two tapered side sections, section 0 on the right side and an identical opposing section on the left side (not shown). The rear face of the smoke chamber N includes four trapezoidal pieces, similar to the front face M, except that they are not notched at the corners, but rather they are straight-cut pieces at the edges which abut the planar inner face of the side sections, such as 0 on the right side. It will be readily understood, therefore, that although the front and back faces of the smoke chamber M and N are almost similar in construction, each piece is a different shape because the front face sections are notched and the rear face sections are not.

The smoke chamber may be extended and further tapered by sections Q, R, P-1 and O-1, dimensioned and arranged as shown in FIG. 1.

Figure 2:
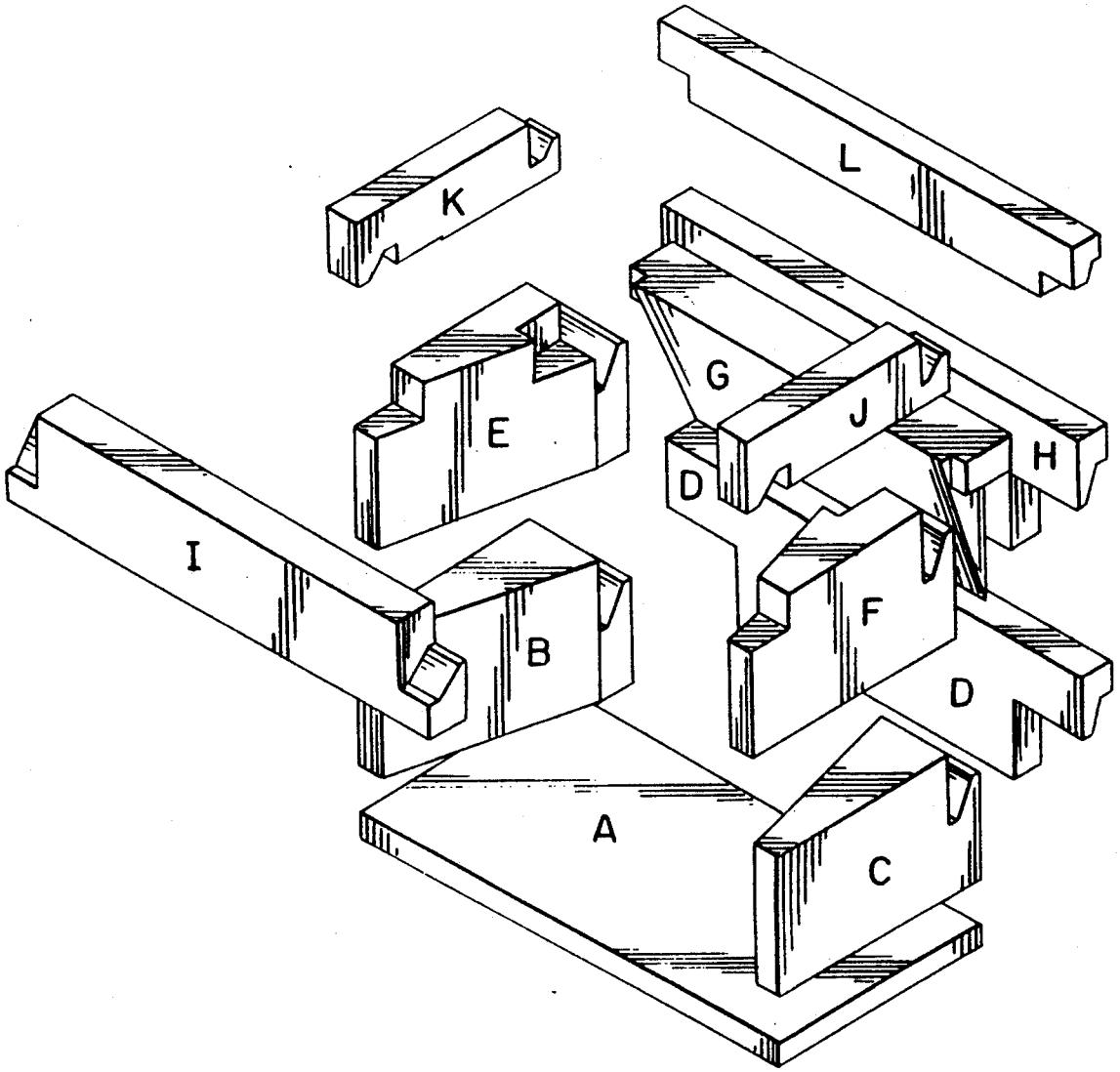
FIG. 2 is an exploded isometric view showing the various sections which comprise the firebox portion of the present invention.

Referring now to FIG. 2, more detail of the corner joints of the firebox are shown. Bottom firebox side sections B and C have a vertically extending wedge-shaped jaw at the rear which receives complementary and interlocking wedge-shaped rear arms which extend from the top of the lower most rear firebox section D. Next, middle tier firebox side sections E and F rest upon side sections B and C, and sections E and F also contain wedge-shaped notching which receives abutting rear pieces G and H. Next, the upper tier of the firebox is comprised of interlocking sections I, K L and J with vertically extending wedge-shaped joints at each corner. It will be readily understood that because of the vertically extending wedge-shaped joinery that the downward force of weight added to the firebox will strengthen the interlocking of the firebox sections.

Figure 4:
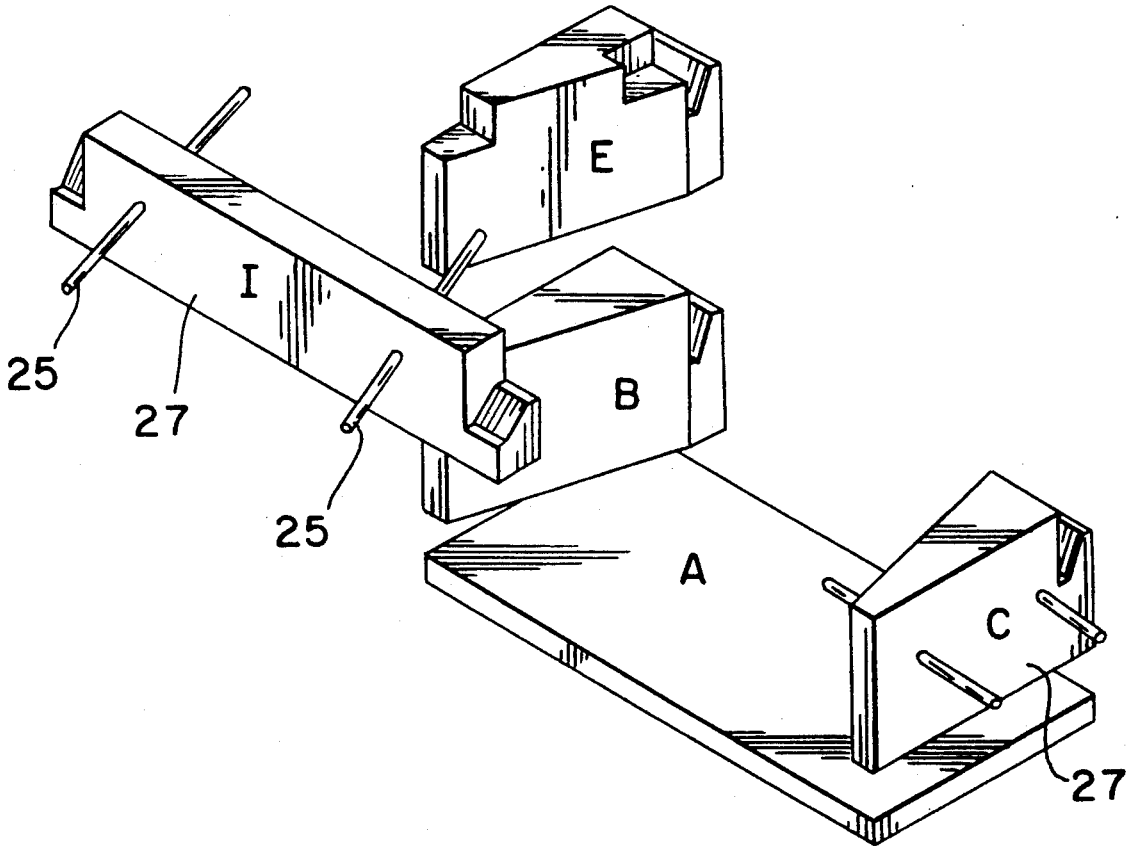
FIG. 4 are isometric views of modular sections showing handling dowels inserted therein.

The firebox sections are extremely robust compared to prior art modular sections and, thus, provide a solid and much stronger assembly. A typical dimension for the width of the sections is 4", however, it will be readily apparent from FIG. 2 that side sections E, B, F and C are thicker at the rear. This provides both a tapering of the firebox from the front converging to the rear, and also makes the bottommost sections which must support more of the weight to be stronger. Because of the increased size and weight of some of the sections, holes are precast in each section to receive handling dowels 25 which are shown in FIG. 4 inserted through upper tier face plate I and lower side section C. These dowels facilitate the lifting and placing of the sections.

Figure 3:
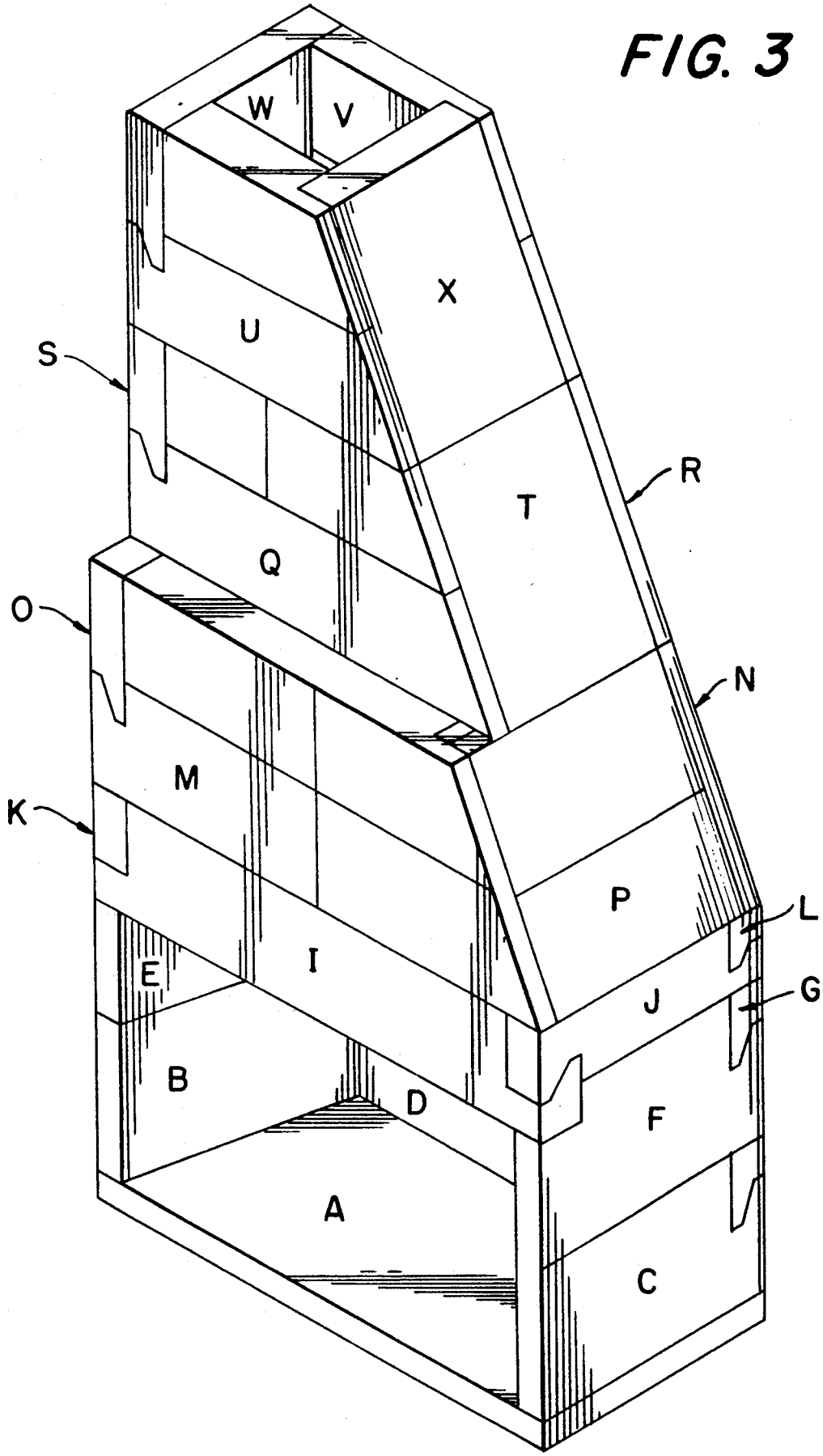
FIG. 3 is an alternate embodiment of the present invention in which three of the four sides of the smoke chamber are vertical and only one side is angled.

Referring now to FIG. 3, an alternate embodiment of the fireplace invention is shown. The orientation and structure of the firebox sections remain the same, however, the smoke chamber has three vertical sides and only one inclined side. This embodiment is particularly useful if the fireplace is to be fitted adjacent an existing vertical heater flue on one side of the fireplace. As seen in this figure, sections O and S continue the vertical side surface directly above the left lateral side of the firebox. The opposing lateral side sections X, T and P form the non-load-bearing angled side which tapers the top of the firebox down to the size of the chimney opening at the top represented by the four uppermost sections V, W, U and X as shown in this figure.

Referring to FIG. 4, holes may be precast in some of the heavier sections or those which require greater lifting. The dowel holes are angled upward as they pass through the casting from the outside face 27 of the sections. Handling dowels 25, which may be simple steel rods, can be inserted into the holes and used as lifting handles for lifting sections into place. Thereafter, the dowels are removed and the holes are filled with cement. The dowel holes are not only advantageous for fitting the dowel handles as described, but also once the correct inside or outside face of the section is determined, the angulation of the dowel holes will further indicate the top and bottom of the section because the holes are all angled in the upward direction when in their proper assembled location.

The materials used for casting the various sections herein described are an important feature of the present invention. The composition of the cast sections is a similar material from which flue liners are cast. This material is particularly heat resistant and is normally added to the usual fireplace masonry in the chimney or flue area. The typical mix for casting the sections of the present invention is one part Luminate cement; four parts perlite aggregate; and 0.4 parts water, mixed in these volumetric portions. With the present fireplace, since all of the sections are cast of this material, the entire firebox and smoke chamber are extremely heat resistant and, therefore, no separate flue liner is required. This saves both the cost of an additional flue liner and the additional labor of installing it.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A modular fireplace constructed from the assemblage of individual interlocking masonry sections, comprising:

a base;

a firebox assembly resting on said base and containing a plurality of vertically extending tiers, each tier having separate masonry sections which are joined at their side edges forming the corners of the firebox, each corner joint including vertically-extending interlocking jaws formed in the side edges of said sections, said tiers being of different heights from one another;

a smoke chamber, comprising load-bearing vertical sections; and means abutting the sides of said vertical sections for enclosing said smoke chamber without supporting the load which rests upon said vertical sections.

2. The fireplace of claim 1 wherein said smoke chamber has four sides, front and rear load-bearing vertical sides, and left and right inclined non-load-bearing sides.

3. The fireplace of claim 2 wherein said sections further include dowel holes formed therein for receiving lifting dowels, said holes being substantially horizontal, but angled upward as they pass through the outside faces of said sections.

4. The fireplace of claim 3 wherein said sections are cast masonry blocks, comprised of a material which can safely withstand chimney temperatures.

5. The fireplace of claim 4 wherein said sections are composed of the casting ingredients of Luminate cement, perlite aggregate, and water.

6. The fireplace of claim 5 wherein said casting composition materials are mixed in the following volumetric portions: one part of Luminate cement to four parts of perlite aggregate to 0.4 parts of water.

7. A modular fireplace constructed from the assemblage of individual interlocking masonry sections, comprising:

a base;

a firebox assembly resting on said base and containing a plurality of vertically extending tiers, each tier having separate masonry sections which are joined at their side edges forming the corners of the firebox;

a plurality of dowel holes formed through the outer faces of said sections for receiving lifting dowels, said holes being angled upward through said sections; and a plurality of loose dowels dimensioned to fit within said dowel holes, such that when inserted into said holes, said dowels form retractable lifting handles for assembly personnel to lift and place said masonry sections.

* * * * *